United States Patent [19]

Coupland et al.

[11] 4,244,829

[45] Jan. 13, 1981

[54] HYDROCARBON-SOLUBLE EPOXIDIZED FATTY ACID ESTERS AS LUBRICITY MODIFIERS FOR LUBRICATING OILS

[75] Inventors: Keith Coupland, Sarnia; Clinton R. Smith, Camlachie, both of Canada

[73] Assignee: Exxon Research & Engineering Co., Florham Park, N.J.

[21] Appl. No.: 884,132

[22] Filed: Mar. 7, 1978

[51] Int. Cl.[3] ..... C10M 1/26

[52] U.S. Cl. ..... 252/56 R

[58] Field of Search ..... 252/56 R; 44/58, 63, 44/66; 260/348.28, 348.58, 348.61, 348.62

[56] References Cited

U.S. PATENT DOCUMENTS

| | | | |
|---|---|---|---|
| 2,897,070 | 7/1959 | Newman et al. | 44/63 |
| 2,900,342 | 8/1959 | Manteuffel et al. | 260/348.58 |
| 2,992,237 | 7/1961 | Dieckelmann | 252/56 R |
| 3,287,273 | 11/1966 | Furey et al. | 44/58 X |
| 3,294,499 | 12/1966 | Brook et al. | 44/63 |
| 4,105,571 | 8/1978 | Shaub et al. | 252/56 R |

FOREIGN PATENT DOCUMENTS

| | | | |
|---|---|---|---|
| 1954452 | 5/1971 | Fed. Rep. of Germany | 252/56 R |
| 1284512 | 8/1972 | United Kingdom . | |

*Primary Examiner*—W. J. Shine

*Attorney, Agent, or Firm*—Roland A. Dexter; Frank T. Johmann

[57] ABSTRACT

Hydrocarbon-soluble epoxidized fatty acid esters prepared by the epoxidation of unsaturated carboxylic acid esters are useful hydrocarbon additives. Their incorporation into a suitable hydrocarbon functional fluid such as a lubricating oil gives improved antiwear and antifriction properties.

9 Claims, No Drawings

HYDROCARBON-SOLUBLE EPOXIDIZED FATTY ACID ESTERS AS LUBRICITY MODIFIERS FOR LUBRICATING OILS

BACKGROUND OF THE INVENTION

The present invention relates to hydrocarbon-soluble epoxidized fatty acid esters and their utility as an additive for hydrocarbon compositions such as gasoline, fuel oil and lubricating oils including greases, industrial oils, gear oils and lubricants for engines and other equipment having moving parts operating under boundary lubricating conditions.

There are many instances, as is well known, particularly under "Boundary Lubrication" conditions where two rubbing surfaces must be lubricated, or otherwise protected, so as to prevent wear and to insure continued movement. Moreover, where, as in most cases, friction between the two surfaces will increase the power required to effect movement and where the movement is an integral part of an energy conversion system, it is most desirable to effect the lubrication in a manner which will minimize this friction. As is also well known, both wear and friction can be reduced, with various degrees of success, through the addition of a suitable additive or combination thereof, to a natural or synthetic lubricant. Similarly, continued movement can be insured, again with varying degrees of success, through the addition of one or more appropriate additives.

While there are many known additives which may be classified as antiwear, antifriction and extreme pressure agents and some may in fact satisfy more than one of these functions as well as provide other useful functions, it is also known that many of these additives act in a different physical or chemical manner and often compete with one another, e.g. they may compete for the surfact of the moving metal parts which are subjected to lubrication. Accordingly, extreme care must be exercised in the selection of these additives to insure compatibility and effectiveness.

Known ways to solve the problem of energy losses due to high friction, e.g. in crankcase motor oils include the use of insoluble molybdenum sulfide and graphite dispersions which are expensive and have the disadvantage of giving the oil composition a black or hazy appearance.

Similarly, antifriction agents or oiliness or lubricity agents, as the same are often referred to in the prior art, function by forming a coating on the surface of the moving metal parts. Typical of these compounds are unsaturated fatty acids, e.g. oleic acid which has the disadvantage of being oxidatively unstable, corrosive to metal parts and may interact irreversibly with other components in the lubricant formulation. Less corrosive are the polyol derivatives obtained by the reaction of a polyhydroxy compound with a fatty acid and particularly dimers of unsaturated fatty acids (see U.S. Pat. Nos. 3,180,832 and 3,429,817) but the coating bonds are generally physical in nature and therefore relatively weak.

Another ester type of additive often claimed as a lubricity agent is tricresyl phosphate which contributes phosphorus to the motor oil formulation, an element recognized as a potent poison for emission control device catalysts.

In light of the foregoing, the need for improved lubricating compositions that will permit operation of moving parts under boundary conditions with reduced friction is believed to be readily apparent. Similarly, the need for such a composition that can include conventional base oils and other conventional additives and can be used without the loss of other desirable lubricant properties is also readily apparent.

SUMMARY OF THE INVENTION

It has now been discovered that the foregoing and other disadvantages of the prior art lubricity additives for lubricating compositions can be overcome by a lubricating oil composition of a hydrocarbon, preferably mineral oil, containing a minor but at least friction reducing amount of a hydrocarbon-soluble epoxidized fatty acid ester represented by the following formula I.

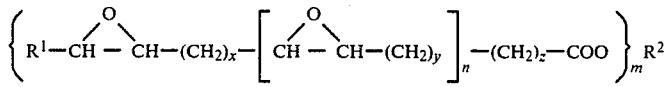

I wherein: $R^1$ is a substantially hydrocarbyl group containing from 1–50, preferably 1–10, carbon atoms and may be linear or branched; x, y and z are integers from 1–20, preferably 1–10 and may be the same or different; n is 0–10, preferably 0–4, m is 1–10, preferably 1–4; and $R^2$ is a substantially hydrocarbyl group containing from 1–50, preferably 1–10, carbon atoms and may be linear or branched. $R^2$ is derived in practice from an alcohol which may be monohydric or polyhydric. It is understood that $R^1$ and $R^2$ substituents can contain substituted pendant hetero groups provided they do not detrimentally alter the hydrocarbon solubility of the epoxidized ester.

In accordance with the present invention, it is preferred that the lubricity enhancing, i.e. friction reducing, additive is present in the hydrocarbon in an amount sufficient to provide from about 0.002 to 10, preferably 0.01 to 1.00, optimally about 0.1–0.4 wt.% oxirane oxygen, all weight percent being based on the total weight of the lubricating composition.

DETAILED DESCRIPTION OF THE INVENTION OIL-SOLUBLE EPOXIDIZED FATTY ACID ESTER

As earlier described, the hydrocarbon-soluble epoxidized fatty acid esters of the invention are believed to conform to said Formula I. The $R^1$ group of said Formula I as defined is substantially hydrocarbyl and thus is alkyl, aryl, aralkyl, cycloalkyl, or alkaryl; however, the hydrocarbyl group may contain polar substituents such as amino, aminoalkyl, hydroxy, hydroxyalkyl, halo, mercapto and keto radicals.

The hydrocarbyl soluble epoxidized fatty acid esters are prepared by the epoxidation of an unsaturated fatty acid ester having a Formula II.

II $$\{R^1-CH=CH-(CH_2)_x-[CH=CH-(CH_2)_y]_n-(CH_2)_z-COO\}_m R^2$$

wherein $R^1$, $R^2$, m, n, x, y and z have the same significance as previously described.

Epoxidation of the unsaturated fatty acid ester may be accomplished by methods well known to those skilled in the art. These methods are described in the following references:

1. Reagents for Organic Synthesis, Fieser M. and Fieser Louis, F., Published by Wiley Interscience, Vol. 1 (1967) (see pp. 88-9, 135-9, 456-67, 743, 791-6, 819-20);
2. Advanced Organic Chemistry: Reactions, Mechanisms, and Structure, March, J., McGraw-Hill (1968) (see pp. 578, 617-21); and,
3. Hydrogen Peroxide in Organic Chemistry, Wallace, J. G., DuPont (1960) (see pp. 6-10).

The unsaturated fatty acid ester (II) is prepared by reaction of an unsaturated fatty acid of Formula III with a suitable alkanol $R^2OH$, where $R^2$ has the same significance as previously described, in the presence if so desired of a catalyst. Suitable catalysts indicate the mineral acids, aryl sulfonic acids, alkaryl sulfonic acid, ion exchange resins, titanium esters, tin salts, zinc oxide, calcium acetate and the like. Formula III is $$R^1-CH=CH-(CH_2)_x-[CH=CH-(CH_2)_y]_n-(CH_2)_z-CO_2H \quad \text{III}$$

where $R^1$, n, x, y and z have the same significance as previously described. Suitable fatty acids include: decyl-9-enoic acid, stillingic acid, dodec-9-enoic acid, palmitoleic acid, oleic acid, ricinoleic acid, petroselenic acid, vaccenic acid, linoleic acid, linolenic acid, eleostearic acid, punicic acid, licanic acid, parinaric acid, gadoleic acid, arachidonic acid, 5-eicosenic acid, 5-docosenic acid, cetoleic acid, erucic acid, 5:13-docosadienic acid, and selacholeic acid. In addition, the fatty acid mixtures obtained by hydrolysis of naturally occurring oils may be used, e.g. cottenseed oil, corn oil, soybean oil, oiticica oil, tung oil, linseed oil and perilla oil.

The naturally occurring unsaturated fatty acids useful in this invention are described in:

"The Chemical Constitution of Natural Fats," 3rd ed., Hilditch, T. P., (London 1956).

In addition, the naturally occurring glycerides of unsaturated fatty acids may be epoxidized to provide additives useful in this application.

The suitable alkanols include both monohydric and polyhydric alcohols.

Monohydric alcohols.

Useful monohydric alcohols can be characterized by the formula $R_3OH$ wherein $R_3$ is an alkyl group containing from 1 to 50, preferably 1 to 12, carbons such as methyl, ethyl, propyl, butyl, etc., and including naturally occurring alkyl groups such as lauryl, stearyl and mixtures thereof.

Polyhydric alcohols.

Useful polyhydric alcohols can have a total of 2 to about 50 carbon atoms and can be represented by the formula:

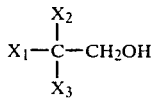

wherein: $X_1$ is hydrogen; $C_1$ to $C_5$ alkyl; hydroxy alkyl $[HO(CH_2)_n]$ wherein n is 1-10; hydroxyalkoxy $[HO(CH_2CH_2O)_n-CH_2CH_2O,]$ wherein n is 1-20; and, $X_2$ and $X_3$ may be the same or different and represent hydrogen, $C_1$ to $C_5$ alkyl and $C_1$ to $C_5$ hydroxyalkyl groups and their ester, ether, acetal or ketal derivatives. An especially preferred class of polyhydric alcohols are typified by glycerol, ehtylene glycol, pentaerythritol, dipentaerythritol, tripentaerythritol, polypentaerythritols, sorbitol, mannitol, cyclohexaamylose, cycloheptaamylose and related polyhydric alcohols such as these prepared via the aldol condensation of formaldehyde with ketones such as acetone, and cyclohexanone.

OTHER ADDITIVES FOR LUBRICATING COMPOSITIONS

In addition to the epoxidized fatty acid ester, the lubricating oil composition may contain other well-known lubricating oil additives to provide trouble-free operation of the lubricated equipment, such as ashless dispersants, metallic detergents, supplemental oxidation and corrosion inhibitors, extreme pressure agents, rust inhibitors, pour point depressants, viscosity index improvers, etc.

1. Ashless Dispersants

As used herein, the terminology "ashless dispersant" is intended to describe the now well-known class of non-metal-containing oil-soluble polymeric additives or the acyl derivatives of relatively high molecular weight carboxylic acids which are capable of dispersing contaminants and the like in hydrocarbons such as lubricating oils. The carboxylic acids may be mono- or polycarboxylic acids and they are generally characterized by substantially hydrocarbon constituents containing an average of 50 to 250 aliphatic carbon atoms.

A preferred class of ashless dispersants are the nitrogen-containing dispersant additives which are generally known in the art as sludge dispersants for crankcase motor oils. These dispersants include mineral oil-soluble salts, amides, imides and esters made from high molecular weight mono- and dicarboxylic acids (and where they exist the corresponding acid anhydrides) and various amines of nitrogen-containing materials having amino nitrogen or heterocyclic nitrogen and at least one amido or hydroxy group capable of salt, amide, imide or ester formation. Usually, these dispersants are made by condensing a monocarboxylic acid or a dicarboxylic acid or anhydride, preferably a succinic acid producing material such as alkenyl succinic anhydride, with an amine or alkylene polyamine. Usually, the molar ratio of acid or anhydride to amine is between 1:1 to 5:1.

Primarily because of its ready availability and low cost, the hydrocarbon portion of the mono-, or dicarboxylic acid or anhydride is preferably derived from a polymer of a $C_2$ to $C_5$ monolefin, said polymer monoolefin generally having between 50 and 250 carbon atoms. A particularly preferred polymer is polyisobutylene.

Polyalkyleneamines are usually used to make the non-metal-containing dispersant. These polyalkyleneamines include those represented by the general formula:

$$NH_2(CH_2)_n-[NH(CH_2)_n]_m-NH_2$$

wherein n is 2 to 3 and m is a number from 0 to 10. Specific compounds coming within the formula include diethylenetriamine, tetraethylenepentamine, dipropylenetriamine, octaethylenenonamine, and tetrapropylenepentamine. N,N-di(2-aminoethyl) ethylenediamine may also be used. Other aliphatic polyamino compounds that may be used are N-amino-alkylpiperazines, e.g. N-(2-aminoethyl) piperazine. Mixtures of alkylene polyamines approximating tetraethylene pentamine are commercially available, e.g. Dow E-100 sold by Dow Chemical Company of Midland, Mich.

Representative dispersants are formed by reacting about one molar amount of polyisobutenyl succinic anhydride with from about one to about two molar amounts of tetraethylene pentamine or with from about 0.5 to 1 moles of a polyol, e.g. pentaerythritol.

It is possible to modify the ashless dispersants generally by the addition of metals such as boron in order to enhance the dispersancy of the additive. This is readily accomplished by adding boric acid to the reaction mixture after the imidation or esterification is substantially complete and heating the mixture at temperatures of 100° to 150° C. for a few hours.

2. Other Additives

Detergents useful in conjunction with dispersants, preferably the ashless type, include normal, basic or overbased metal, e.g. calcium, magnesium, etc., salts of petroleum naphthenic acids, petroleum sulfonic acids, alkyl benzene sulfonic acids, oil-soluble fatty acids, alkyl salicyclic acids, alkyl phenols, alkylene-bisphenols, and hydrolyzed phosphosulfurized polyolefins.

Oxidation inhibitors include phenols, amines, sulfurized phenols, alkyl phenothiazines, and zinc dihydrocarbyl phosphorodithioates (ZDDP).

Pour point depressants include wax alkylated aromatic hydrocarbons, olefin polymers and copolymers, acrylate and methacrylate polymers and copolymers.

Viscosity Index Improvers include olefin polymers such as polybutene, ethylene propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrollidone or dimethylaminoalkyl methacrylate, post grafted polymers of ethylene propylene with an active monomer such as maleic anhydride which may be further reacted with an alcohol or an alkylene polyamine, styrene/maleic anhydride polymers post reacted with alcohols and amines, etc.

The hydrocarbons in which the additive combination of the invention is most effective are mineral oils having a viscosity as measured by ASTM D-445 of from about 2 to 40, preferably 5 to 20, centistokes at 99° C.

If the oil-soluble epoxidized fatty acid ester is used as an additive concentrate, the concentrate may consist essentially of from about 5 to 80 wt.% of the epoxy ester additive (the wt.% based on the total weight of said concentrate), the remainder being a satisfactory solvent such as kerosene, mineral oil, a naphtha and the like. The preferred concentrate contains about 10 to 60 wt.% of the additive combination in the solvent.

Whether the epoxy ester is used alone or in combination with other additives, its concentration may vary appreciably with the particular hydrocarbon. For example, when said epoxy ester is used alone in a fuel such as gasoline, the concentration of the additive ranges from 10 to 1000, preferably 20 to 50 weight parts per million based on the total weight of the fuel composition, whereas in a lubricant, it is used from about 0.1 to 5, preferably 0.2 to 3 wt.% based on the total weight of the lubricating oil.

The invention will be further understood by reference to the following examples which illustrate a preferred form of the invention and compares the same with different, though similar compositions.

The following examples illustrate more clearly the compositions of the present invention. However, these illustrations are not to be interpreted as specific limitations on this invention.

EXAMPLE 1

A lubricant formulation was prepared by blending together the individual components, noted below, usually at a slightly elevated temperature, i.e. from about 45° C. to about 60° C. to insure complete mixing. The final blend was a clear mobile liquid.

| | % Vol |
|---|---|
| Mineral Oil Solvent 150 N | 57.1 |
| Mineral Oil Solvent 100 N | 19.0 |
| Ashless Dispersant | 6.0 |
| Metal Detergent Inhibitor | 3.0 |
| ZDDP | 1.2 |
| Ashless Antioxidant | 0.5 |
| Viscosity Improver | 13.2 |

EXAMPLE 2

The lubricant of Example 1 was modified by the addition of 0.5 wt.% of epoxidized methyl ester of soya bean oil fatty acids containing 7 wt.% of oxirane oxygen and purchased as Vikoflex 7010 from the Viking Chemical Company, Minneapolis, Minn.

EXAMPLE 3

The lubricant of Example 1 was modified by the addition of 0.5 wt.% of epoxidized octyl ester of soya bean oil fatty acids containing 5.6 wt.% of oxirane oxygen and purchased as Vikoflex 7080 from the Viking Chemical Company, Minneapolis, Minn.

EXAMPLE 4

The lubricant of Example 1 was modified by the addition of 0.5 wt.% epoxidized methyl ester of linseed oil fatty acids containing 9.0 wt.% of oxirane oxygen and purchased as Vikoflex 9010 from the Viking Chemical Company, Minneapolis, Minn.

EXAMPLE 5

The lubricant of Example 1 was modified by the addition of 0.5 wt.% of epoxidized isopropyl ester of linseed oil fatty acids containing 8.4 wt.% of oxirane oxygen and purchased as Vikoflex 9030 from the Viking Chemical Company, Minneapolis, Minn.

EXAMPLE 6

The lubricant of Example 1 was modified by the addition of 0.5 wt.% of epoxidized butyl ester of linseed oil fatty acids containing 8.0 wt.% of oxirane oxygen and purchased as Vikoflex 9040 from the Viking Chemical Company, Minneapolis, Minn.

EXAMPLE 7

The lubricant of Example 1 was modified by the addition of 0.5 wt.% of epoxidized hexyl ester of linseed oil fatty acids containing 7.5 wt.% of oxirane oxygen and purchased as Vikoflex 9060 from the Viking Chemical Company, Minneapolis, Minn.

EXAMPLE 8

The lubricant of Example 1 was modified by the addition of 0.5 wt.% of epoxidized octyl ester of linseed oil fatty acids containing 7.0 wt.% of oxirane oxygen and purchased as Vikoflex 9080 from the Viking Chemical Company, Minneapolis, Minn.

EXAMPLE 9

The lubricant of Example 1 was modified by the addition of 0.5 wt.% of epoxidized soya bean oil containing 7.0 wt.% of oxirane oxygen and purchased as Drapex 6.8 from Argus Chemical Corporation, New York, N.Y.

EXAMPLE 10

The lubricant of Example 1 was modified by the addition of 0.5 wt.% of epoxidized linseed oil containing 9.3 wt.% of oxirane oxygen and purchased as Drapex 10.4 from Argus Chemical Corporation, New York, N.Y.

EXAMPLE 11

The lubricant of Example 1 was modified by the addition of 0.5 wt.% of epoxidized methyl ester of tall oil fatty acids containing 5.0 wt.% of oxirane oxygen and purchased as Drapex 4.4 from Argus Chemical Corporation, New York, N.Y.

EXAMPLE 12

A formulated oil was prepared according to Example 1 but using the following components and quantities. The resulting lubricant was an SAE 10W/30 pale amber clear liquid.

| | % weight |
|---|---|
| Base Oil | 81.64 |
| Ashless Dispersant | 1.44 |
| Ashless Dispersant | 4.38 |
| Magnesium Sulfonate | 0.639 |
| Viscosity Improver | 8.850 |
| ZDDP | 1.790 |
| Ashless Rust Inhibitor | 0.236 |
| Viscosity Improver | 0.009 |
| Defoamer | 1.017 |

EXAMPLE 13

The lubricant of Example 12 was modified by the addition of 0.5 wt.% epoxidized methyl ester of linseed fatty acids purchased as Vikoflex 9010 from the Viking Chemical Company, Minneapolis, Minn.

These formulated blends of Examples 1–13 were themselves and in modified form according to the teachings of this invention subjected to several test procedures as hereinafter set forth:

1. Testing Procedure A

A Roxana Four-Ball tester with the Brown/GE modification was used to measure friction by the following procedure. Three one-half inch bearing steel balls HRC 62–64, as described in procedure ASTM D 2266-67, are cleaned by rinsing in a light organic solvent, air dried and placed in the ball pot. A fourth one-half inch ball made of AISI 52100 steel and of hardness RC 20 is soaked in 1 N HCl for 60 seconds, soaked in a basic wash (Decon 75) for 60 seconds, rinsed in water, rinsed in isopropyl alcohol and air dried. This ball is placed in a chuck and mounted on the tester's spindle.

The lubricant (15 mls) is added to the ball pot and the tester is assembled as per the manufacturer's instructions.

A normal load of 15 Kg is applied to the balls and the oil is heated to 110° C. After the lubricant is on temperature, the spindle ball is rotated at 2.5 rpm (0.096 cm/sec). The frictional force is measured by a load cell and displayed on a strip chart recorder. These conditions are maintained for 45 minutes after which the load is dropped to 3 Kg and the test continued for 15 minutes.

Coefficient of friction are calculated over the last 15 minutes at each load.

The results of this test are set forth in Table I.

TABLE I

| Test No. | Lubricant of Example | Coefficient of Friction 15 Kg | Coefficient of Friction 3 Kg | % Friction Reduction* 15 Kg | % Friction Reduction* 3 Kg |
|---|---|---|---|---|---|
| A-1 | 1 | .1658 | .2200 | — | — |
| A-2 | 2 | .1169 | .1265 | 29 | 43 |
| A-3 | 3 | .1368 | .1774 | 17 | 19 |
| A-4 | 4 | .1143 | .0967 | 31 | 56 |
| A-5 | 5 | .1202 | .1094 | 28 | 50 |
| A-6 | 6 | .1183 | .1275 | 29 | 42 |
| A-7 | 7 | .1151 | .1296 | 31 | 41 |
| A-8 | 8 | .1082 | .1455 | 35 | 34 |
| A-9 | 9 | .1100 | .1400 | 34 | 36 |
| A-10 | 10 | .1100 | .1200 | 34 | 45 |
| A-11 | 11 | .1400 | .1800 | 16 | 18 |

*Relative to results obtained using the lubricant of Example 1

2. Procedure B

Ball-on-cylinder test using the apparatus described in the "Journal of the American Society of Lubrication Engineers," entitled "ASLE Transactions," Vol. 4, pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, a constant rpm and a fixed time and in each of the tests of this Example, a 4 Kg load, 0.26 rpm and 120 minutes was used. The coefficent of friction was determined from the power actually required to effect rotation and the percent friction reduction determined by reference to a lubricant not containing a lubricity additive. The apparatus and method used is more fully described in U.S. Pat. No. 3,129,580, which was issued May 21, 1964 to Furey et al and which is entitled "Apparatus For Measuring Friction and Contacts Between Sliding Lubricating Surfaces."

The results of tests conducted under this procedure are set forth in Table II.

TABLE II

| Test No. | Lubricant of Example | Coefficient of Friction | % Friction Reduction* |
|---|---|---|---|
| B-1 | 1 | 0.32 | — |
| B-2 | 4 | 0.12 | 63 |
| B-3 | 8 | 0.18 | 44 |

*Relative to the results obtained using the lubricant of Example 1.

3. Procedure C

An automotive engine (350 CID Chevrolet 8-cylinder) mounted on a load absorbing dynamometer and equipped for accurate temperature and speed control was operated on lead-free fuel at constant load. The fuel consumption was accurately metered throughout the test. Engine speed was controlled at 2200 rpm and the engine torque at 900 in/lb which simulates a complete vehicle driving over level road at a speed of 55 mph.

The results of tests conducted under this Procedure C are set forth in Table III.

TABLE III

| Test No. | Lubricant of Example | Fuel Flow (cm/100 sec) | Fuel Economy Improvement* (%) |
|---|---|---|---|
| C-1 | 12 | 369.1 | — |
| C-2 | 13 | 358.6 | 2.8 |

*Relative to the results obtained using the lubricant of Example 12

From the foregoing data presented in Tables I–III, it is shown that the additives of the invention provide lubricity enhancement to lubricating oils. The results of the test under Procedure C have been found to correspond to increased mileage per gallon of 5 to 6% when a lubricating oil corresponding to that of Example 13 is used in a car fleet representative of the North American car population.

It is to be understood that the Examples present in the foregoing specification are merely illustrative of this invention and are not intended to limit it in any manner; nor is the invention to be limited by any theory regarding its operability. The scope of the invention is to be determined by the appended claims.

What is claimed is:

1. In a lubricating motor oil composition comprising a major amount of a mineral lubricating oil and minor amounts of ashless dispersant, metal-containing detergent, viscosity index improver and zinc dihydrocarbyl phosphorodithioate additives, the improvement which comprises including in said composition as a fuel economy additive, a minot but at least friction-reducing amount in the range of about 0.2 to about 3 wt. % of an oil-soluble friction reducing polyepoxidized fatty acid ester selected from the group consisting of: methyl ester of soya bean fatty acids, $C_1$ to $C_{12}$ monohydric alcohol ester of linseed oil fatty acids, soya bean oil and linseed oil.

2. In a lubricating composition according to claim 1 wherein said oil has a viscosity (as measured by ASTM D-445) of from about 2 to 40 centistokes at 99° C. and said fatty acid ester is present in amount which provides between 0.01 to 1.00 percent of oxirane oxygen in said composition.

3. In a lubricating composition according to claim 1 wherein said ester is said methyl ester of soya bean oil fatty acids.

4. In a lubricating composition according to claim 1 wherein said ester is said ester of linseed oil fatty acids.

5. In a lubricating composition according to claim 2 wherein said $R^2$ is methyl.

6. An automotive SAE 10W/30 lubricating oil composition for gasoline engines comprising a major amount of mineral lubricating oil and containing an ashless dispersant, a metal-containing detergent, a viscosity index improver, and zinc dihydrocarbyl phosphorodithioate, which oil has been improved so as to give increased fuel economy when used in a gasoline engine, by the addition of about 0.5 weight percent of epoxidized methyl ester of linseed oil fatty acid having about 9 wt% oxirane oxygen.

7. A method of improving the operation of an automotive gasoline engine having a lubricating system by using as the lubricant a motor oil comprising a major amount of mineral lubricating oil, an ashless dispersant, a metal-containing detergent, a viscosity index improver and zinc dihydrocarbyl phosphorodithioate, and containing as a fuel economy additive epoxidized methyl ester of linseed oil fatty acid having about 9 wt% of ozirane oxygen.

8. In a lubricating composition according to claim 1, wherein said ester is soya bean oil.

9. In a lubricating composition according to claim 1, wherein said ester is linseed oil.

* * * * *